US010543507B2

(12) United States Patent
Roth

(10) Patent No.: US 10,543,507 B2
(45) Date of Patent: Jan. 28, 2020

(54) CASING FOR RECEIVING AND FITTING A CARTRIDGE ON AN EJECTION DEVICE, AND EJECTION DEVICE

(71) Applicant: Marco Roth, Haibach (DE)

(72) Inventor: Marco Roth, Haibach (DE)

( * ) Notice: Subject to any disclaimer, the term of this patent is extended or adjusted under 35 U.S.C. 154(b) by 0 days.

(21) Appl. No.: 16/097,373

(22) PCT Filed: Jun. 19, 2017

(86) PCT No.: PCT/EP2017/064941
§ 371 (c)(1),
(2) Date: Oct. 29, 2018

(87) PCT Pub. No.: WO2017/220494
PCT Pub. Date: Dec. 28, 2017

(65) Prior Publication Data

US 2019/0143365 A1 May 16, 2019

(30) Foreign Application Priority Data

Jun. 20, 2016 (DE) ..... 20 2016 103 241 U

(51) Int. Cl.
*B05C 17/005* (2006.01)
*B05C 17/015* (2006.01)
*B05C 17/01* (2006.01)

(52) U.S. Cl.
CPC ..... *B05C 17/00576* (2013.01); *B05C 17/01* (2013.01); *B05C 17/015* (2013.01)

(58) Field of Classification Search
CPC .. B05C 17/00576; B05C 17/01; B05C 17/015
(Continued)

(56) References Cited

U.S. PATENT DOCUMENTS 1,269,438 A * 6/1918 Hieatzman ..... B05C 17/0103 206/384
1,999,598 A * 4/1935 Levine ..... B65D 85/84 206/524.2

(Continued)

FOREIGN PATENT DOCUMENTS

DE 3714138 A1 1/1988
JP S61238359 A 10/1986

OTHER PUBLICATIONS

International Search Report, dated Sep. 12, 2017, corresponding to Application PCT/EP2017/064941.

*Primary Examiner* — Patrick M. Buechner
*Assistant Examiner* — Michael J. Melaragno
(74) *Attorney, Agent, or Firm* — Ladas & Parry LLP; Malcolm J. MacDonald

(57) ABSTRACT

A casing for coaxially receiving and fitting a cartridge or a cartridge-like container on an ejection device for ejecting a viscous compound, wherein at least one shell portion of the casing is telescopic, and wherein the telescopic portion has at least two tubular portions which are arranged coaxially to one another in certain portions, and which are displaceable relative to one another in the axial direction. The tubular portions are inter-engaged via latching elements and can be locked relative to one another in different positions, and that the first tubular portion has a flange with a coupling element at a first end and can be releasably connected by the coupling element to the ejection device directly or via an intermediate piece, and that the first tubular portion has a sliding portion on which the second tubular portion is displaceable between a first locked position into a second locked position.

15 Claims, 3 Drawing Sheets

Figure 1:
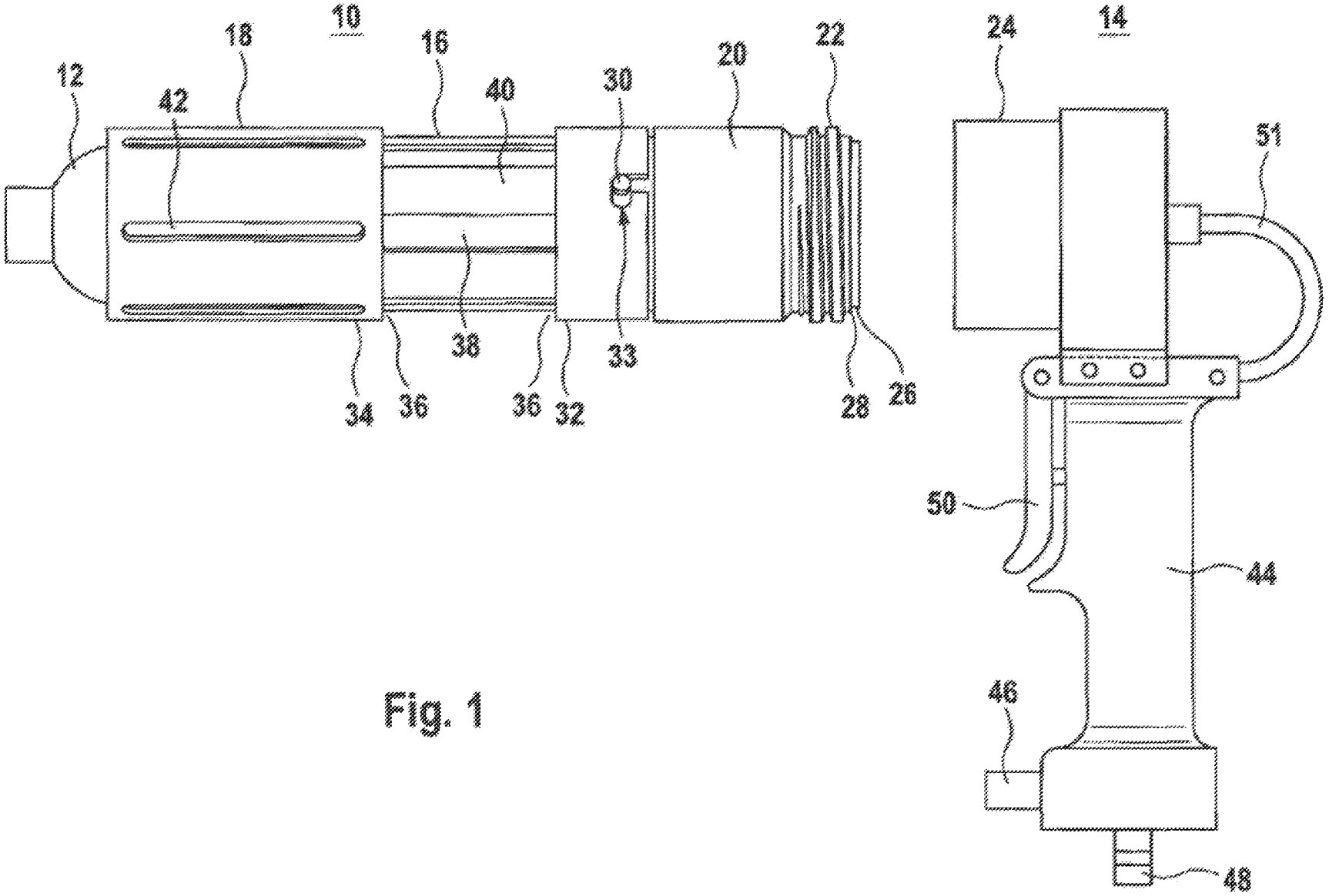

(58) Field of Classification Search
USPC ..... 222/379, 522–525
See application file for complete search history.

(56) References Cited

U.S. PATENT DOCUMENTS 2,205,604 A * 6/1940 Sherbondy ..... B05C 17/01 222/255
2,893,613 A * 7/1959 Davis ..... B65D 35/38 222/566
2,898,019 A * 8/1959 Williams ..... B43M 11/06 222/551
3,231,156 A * 1/1966 Schultz ..... A61M 3/00 222/107
3,275,179 A * 9/1966 Lux ..... B29C 44/1228 156/73.5
3,286,934 A * 11/1966 Schneller ..... B05B 11/045 222/212
3,487,979 A * 1/1970 Hartley ..... B65D 83/386 222/183
3,512,684 A * 5/1970 Sutton ..... B05C 17/0123 222/327
3,726,440 A * 4/1973 Deeb ..... B05C 17/0123 222/174
3,731,848 A * 5/1973 Nakanishi ..... B65D 47/12 222/129
3,930,599 A * 1/1976 Brothers ..... B65D 43/0212 222/143
3,985,268 A * 10/1976 Wood ..... B05C 17/00583 222/108
4,098,434 A * 7/1978 Uhlig ..... B65D 83/0055 222/105
4,210,253 A * 7/1980 Rosler ..... B65D 21/086 220/8
D258,051 S * 1/1981 Bakus ..... D9/445
4,388,011 A * 6/1983 Smith ..... A46B 11/0027 132/308
4,457,641 A * 7/1984 Smith ..... A46B 11/0027 222/390
4,583,934 A * 4/1986 Hata ..... B05C 17/0103 222/327
4,669,636 A * 6/1987 Miyata ..... B05C 17/0103 222/153.01
4,676,657 A * 6/1987 Botrie ..... B01F 5/0615 222/129
4,735,509 A * 4/1988 Rausch ..... B01F 11/0054 222/129
4,799,801 A * 1/1989 Bruning ..... B01F 7/0045 206/219
4,821,897 A * 4/1989 Weiler ..... B29C 49/20 215/251
4,957,223 A * 9/1990 Beilush ..... B05C 17/00583 222/326
5,078,287 A * 1/1992 Holmes, III ..... A61J 9/00 215/11.1
5,137,184 A * 8/1992 Jackson ..... B05C 17/00506 222/327
5,253,785 A * 10/1993 Haber ..... A61M 5/19 222/135
5,301,839 A * 4/1994 Eierle ..... B05C 17/00576 222/105
5,303,852 A * 4/1994 Yamawaki ..... B65D 83/0055 222/209
5,312,018 A * 5/1994 Evezich ..... B65D 83/0055 222/105
5,678,729 A * 10/1997 Raymond ..... B65D 1/023 215/230
5,740,792 A * 4/1998 Ashley ..... A61M 15/0065 128/203.15
5,749,502 A * 5/1998 Hinds ..... B05B 9/0822 222/386.5
5,960,998 A * 10/1999 Brown ..... B05B 11/0005 222/131
6,223,941 B1 * 5/2001 Nealey ..... B05C 17/00583 222/105
6,364,163 B1 * 4/2002 Mueller ..... B05B 11/048 222/105
6,395,006 B1 * 5/2002 Burchett ..... A61B 17/8816 606/92
6,454,136 B1 * 9/2002 Evans ..... B05C 17/01 222/174
6,578,573 B2 * 6/2003 Koch ..... A61M 16/12 128/200.14
6,832,797 B1 * 12/2004 Gassel ..... A47F 7/0028 211/70.6
7,308,993 B2 * 12/2007 Mineau ..... B65D 83/203 222/182
7,410,080 B2 * 8/2008 Good ..... A45F 5/02 224/251
8,627,975 B1 * 1/2014 Whitbeck ..... B65D 35/32 220/254.1
8,783,514 B2 * 7/2014 Terhardt ..... B05C 17/015 222/105
9,796,508 B1 * 10/2017 Rutherford ..... B65D 59/04
2001/0048198 A1 * 12/2001 Dulin ..... B65D 35/44 277/316
2002/0020718 A1 * 2/2002 Summons ..... B65B 3/14 222/327
2005/0211734 A1 * 9/2005 Spada ..... B65D 41/0428 222/420
2005/0230439 A1 * 10/2005 McKee ..... B65D 41/0407 222/568
2007/0181573 A1 * 8/2007 Dawson ..... A45C 11/00 220/4.21
2009/0045227 A1 * 2/2009 Abudi ..... B05C 17/01 222/174
2009/0272767 A1 * 11/2009 Herman ..... G01F 11/026 222/326
2009/0302055 A1 * 12/2009 Cadden ..... B05C 17/00506 222/1
2010/0038381 A1 * 2/2010 Suchan ..... A61C 9/0026 222/137
2010/0155431 A1 * 6/2010 Bartolucci ..... B05C 17/00583 401/171
2010/0213217 A1 * 8/2010 Strong ..... B05C 17/015 222/327
2011/0278327 A1 * 11/2011 Herman ..... B05C 17/01 222/326
2012/0228330 A1 * 9/2012 Gardner ..... B05B 15/628 222/174
2012/0318826 A1 * 12/2012 Naughton ..... B05C 17/01 222/327
2014/0110432 A1 * 4/2014 Hanten ..... B65D 33/1641 222/83
2014/0252044 A1 * 9/2014 Greter ..... B05C 17/00596 222/326
2016/0008842 A1 * 1/2016 Dobbin ..... B05C 17/015 222/389
2016/0158776 A1 * 6/2016 Sternberg ..... B65D 23/12 53/431
2016/0243581 A1 * 8/2016 Clemens ..... B05C 17/00583
2016/0271642 A1 * 9/2016 Clemens ..... B05C 17/00583
2017/0157639 A1 * 6/2017 Nelson ..... B05C 17/00513
2018/0044070 A1 * 2/2018 Coe ..... B25H 3/00
2018/0104714 A1 * 4/2018 Coe ..... B65D 77/0486
2019/0143365 A1 * 5/2019 Roth ..... B05C 17/01

* cited by examiner

Fig. 2
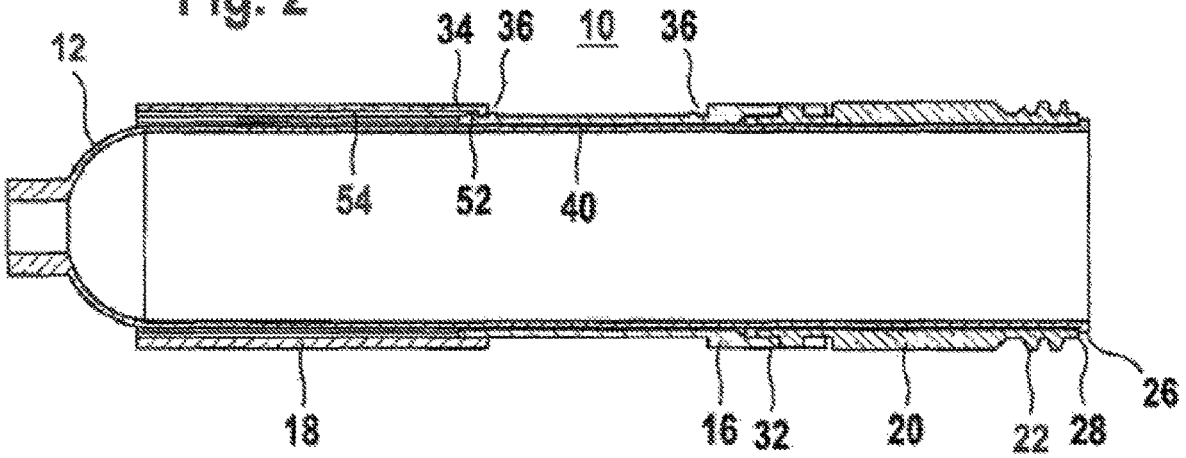
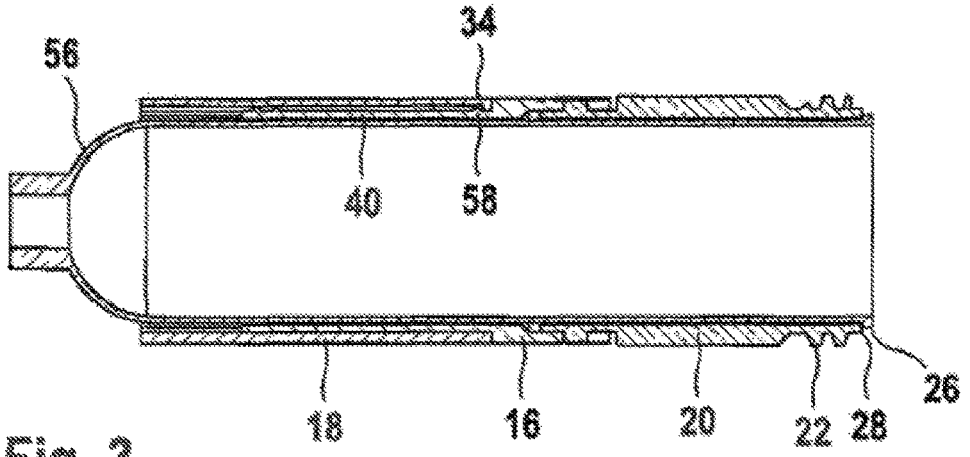
Fig. 3
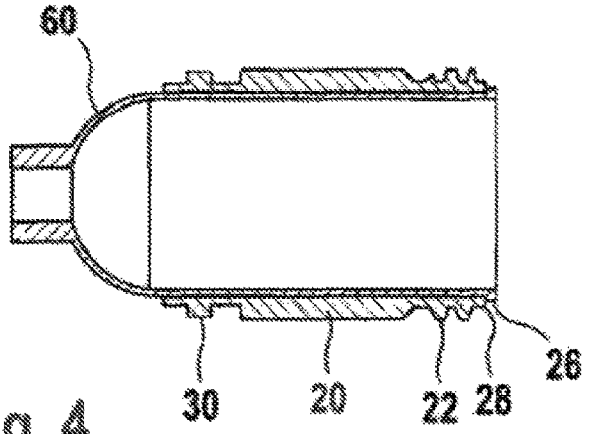
Fig. 4

CASING FOR RECEIVING AND FITTING A CARTRIDGE ON AN EJECTION DEVICE, AND EJECTION DEVICE

The invention relates to a casing for coaxially receiving and adapting a cartridge or a cartridge-like container which can be compressed in the axial direction on an ejection device for ejecting a viscous compound such as a sealing compound contained in the cartridge or in the cartridge-like container, wherein at least one jacket part of the casing is designed to be telescopic, and wherein the telescopic jacket part comprises at least two tubular parts which are arranged coaxially in parts relative to each other and which can be shifted in the axial direction relative to each other.

Furthermore, the invention relates to an ejection device with an adaptable casing for coaxially receiving a cartridge or a cartridge-like container.

A casing and an ejection device of the initially cited type is known from DE 37 14 138 A1. The ejection device in the shape of a joint filling press for pasty, single-component sealants comprises a housing into which a sealant package can be set. Furthermore, a device is provided with which a screw spring can be tightened which actuates a piston for continuously pressing out the sealant in the package. In order to shape the joint filling press to be extremely short and manageable in its entire length, the housing is designed to be telescopic.

DE 37 08 803 A1 relates to a mixing device for pasty, multi-component masses. The pasty components are at first contained in the separate tube parts. The tube parts are connected to each other before the mixing in order to form a cartridge with a cylindrical inner wall. A mixing device consisting of a disk driven in a nonrotating manner and of a relatively stationary disk is located in the cartridge. The disk can be driven by a rod projecting out of the cartridge and with a rotary tool. Both disks are moved axially to the cartridge by moving the rotary tool back and forth. After the mixing process has been carried out by moving and redistributing the masses, the piston is pushed forward in order to press the mixture out of the cartridge.

DE 10 2008 037 686 A1 relates to a container with at least one chamber for receiving a substance and which comprises a bringing-out opening and another opening which is closed by a piston which can be shifted in the chamber and is for bringing out the substance. Furthermore, the container comprises a piston rod arrangement for shifting the piston in the chamber. The piston rod arrangement is constructed by several piston rods which can be transferred with the aid of a spring element from a first bringing-out stage into a second bringing-out stage.

EP 2 965 826 A2 relates to a casing which is constructed as a single-piece tube part of metal or plastic for the reception and which is adapted to the length of a cartridge or of a cartridge-like container. Cartridges with the designation SEMCO® or SEMKIT® offered by the PPG Industries or cartridges with a similar construction can be used.

In order to receive cartridges with different lengths, casings with different lengths are obligatorily necessary. The casing is constructed as a metallic protective tube which comprises on a first end a coupling element such as a bayonet closure for the detachable coupling to the ejection device. On a second end the tubular casing comprises an opening through which an exit opening of the cartridge is guided.

In order to work cartridges of different lengths, as a consequence, according to the prior art several casings are necessary, which is associated with increased costs and a complex storage.

Starting from the above, the present invention has the basic problem of further developing a casing and an ejection device of the initially cited type in such a manner that the working of cartridges with different lengths is simplified with great reliability.

The invention solves the problem in that the tubular parts are cogged to each other by catch elements and can be stopped in different positions relative to each other, that the first tubular part comprises on a first end a flange with coupling element and can be connected with the coupling element directly or by an intermediate piece in a detachable manner to the ejection device, and that the first tubular part comprises a sliding part on which the second tubular part in the form of a sliding jacket can be shifted between a first stoppable position into at least one second stoppable position.

This has the advantage that an adaptation to cartridges with different lengths can be made without problems with a single casing.

The telescopic part comprises at least two tubular parts which are arranged coaxially to one another in parts and which can shift in an axial direction relative to each other. This embodiment is distinguished by an economical production and a simple handling.

The tubular sections are cogged to each other by catch elements and can be stopped in different positions relative to each other in order to ensure a reliable adaptation to cartridges with different lengths.

The first tubular part comprises on a first end a flange with a coupling element and can be connected with the coupling element directly or by an intermediate piece in a detachable manner to the ejection device. In addition, the first tubular part comprises a sliding part on which the second tubular part in the form of a sliding casing can be shifted between a first stoppable position into at least one second stoppable position.

A stopping is preferably achieved in that the second, shiftable part comprises catch elements such as catch noses on a front side facing the first, fixed part, which elements cooperate with corresponding catch elements such as projections or catch noses starting from the sliding part.

In order to achieve a simple assembly of the telescopic casing, it is provided that the first part comprises webs forming the sliding part and starting from the flange and extending in the axial direction, wherein the webs comprise the catch elements such as catch noses on their ends against which rest in an end position the catch noses of the second, shiftable part.

In order to observe the filling state of the cartridge from the outside, it is provided that the second, shiftable part comprises recesses in the form of longitudinal slots as viewing windows in a jacket surface which correspond to corresponding recesses between the webs of the first, fixed part.

In order to receive short cartridges, it is provided that the intermediate part forms a third, tubular jacket part, wherein the jacket part can be connected on a first end via a first connection such as a thread to a flange such as a threaded flange of the ejection device, and wherein the jacket part can be connected on a second end by a second connection like a bayonet closure to the first part of the telescopic jacket part. Consequently, at least three cartridge lengths can be processed with only two jacket parts.

The coupling element is preferably designed as a thread which can be directly connected like being screwed in to the flange like a thread flange of the ejection device.

An adapter ring with a conical clamping surface tapering in the direction of the flange opening is especially preferably arranged in the flange. During the screwing in of the casing with the cartridge, the circumferential edge is loaded with force by the conical clamping surface in a radial direction and is fixed against the inner surface of the flange.

The adapter ring can be constructed as an individual structural component or as an integral component of the ejection device.

The coupling element is preferably constructed as a pin which cooperates in the shape of a bayonet closure with an L-shaped receptacle, wherein a part of the receptacle running in a circumferential direction is aligned in such a manner that the closing of the bayonet closure brings about a tightening of the intermediate part.

In order to further improve the safety, it is provided that the second telescopic part comprises a tapering on the front side. This prevents, as a result, that the cartridge is catapulted when loaded with compressed air in an unintended matter out of the casing.

The third jacket part for receiving cartridges or cartridge-like containers is preferably constructed with a length L0 in a range of 80 mm≤L0≤120 mm, preferably L0=ca. 100 mm.

In a pushed-in state, the telescopic jacket part preferably has a length L in a range of 80 mm≤L≤120 mm, preferably L=ca. 100 mm and in a drawn-out state a length L2 in a range of 120 mm L1≤L2≤220 mm, preferably L2=ca. 200 mm, so that cartridges with lengths in a range of ca. 100 mm, ca. 180 mm and ca. 200 mm and ca. 300 mm can be received.

The casing is preferably produced from plastic or metal such as aluminum.

Furthermore, the invention relates to an ejection device with an adaptable casing for the coaxial receiving of a cartridge or of a cartridge-like container and for ejecting a viscous compound such as a sealing compound, adhesive or hot-melt adhesive, wherein at least one jacket part of the casing is designed to be telescopic and wherein the telescopic jacket part comprises at least two tubular parts which are arranged coaxially to each other by parts and can be shifted relative to each other in an axial direction. It is provided that the tubular parts are cogged to each other by catch elements and can be stopped in different positions relative to each other, that the first tubular part comprises on a first end a flange with coupling element and can be connected with the coupling element directly or via an intermediate part to the ejection device in a detachable manner, and that the first tubular part comprises a sliding section on which the second tubular part in the form of a sliding jacket can be shifted between a first stoppable position into at least one second stoppable position.

Other details, advantages and features of the invention result not only from the claims, the features to be gathered from the latter—independently and/or in combination—but also from the following description of preferred exemplary embodiments to be gathered from the figures.

Figure 5:
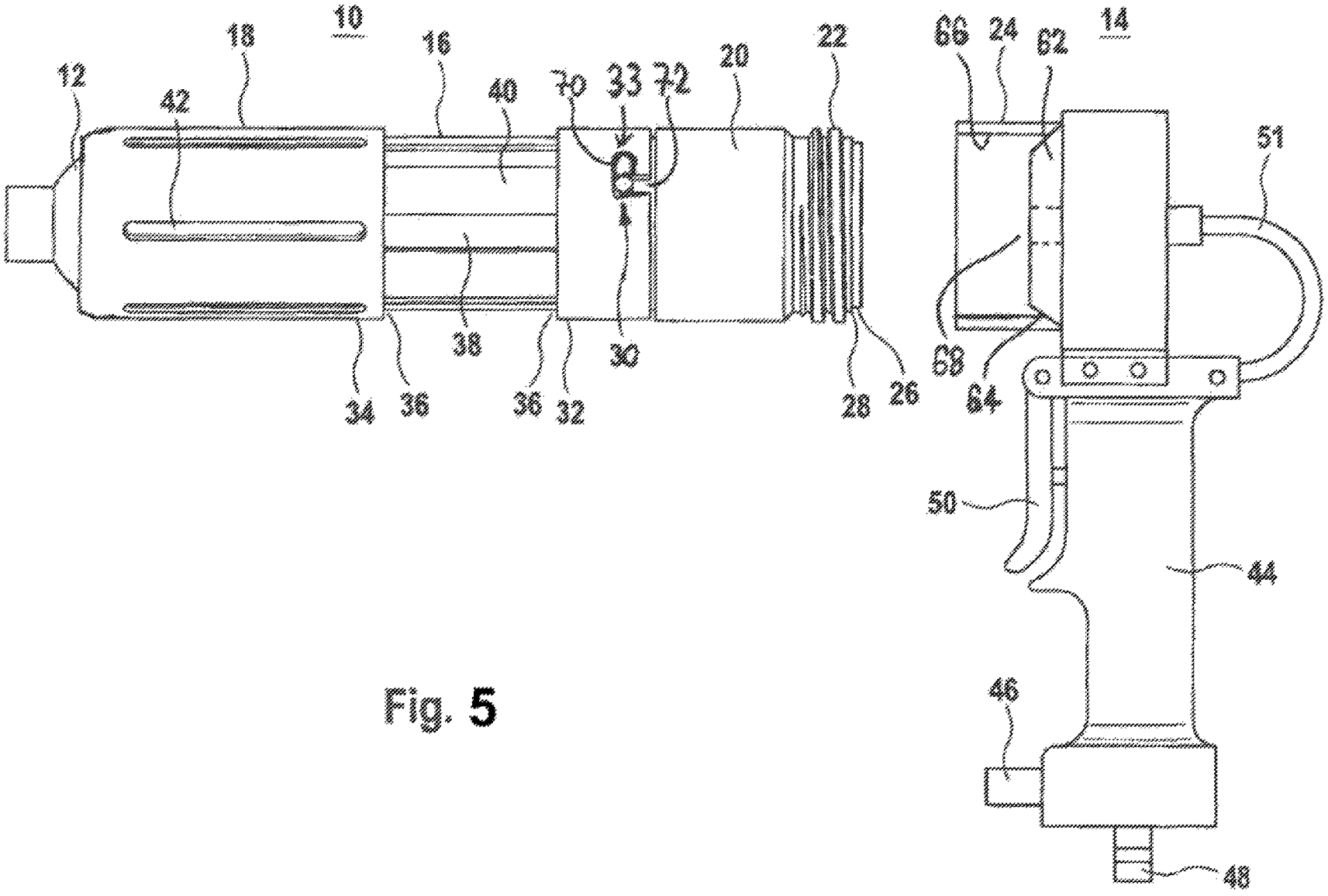

In the figures:

FIG. 1 shows a telescopic casing with a received cartridge for adaptation to an ejection device, FIG. 2 shows the telescopic casing in a pushed-out state, FIG. 3 shows the telescopic casing in a pushed-in state, FIG. 4 shows a non-telescopic jacket part as an intermediate piece, and FIG. 5 shows the telescopic casing with a received cartridge according to FIG. 1 with an adapter ring for adaptation to the ejection device.

FIG. 1 shows a casing 10 for the coaxial receiving and adaptation of a cartridge 12 or of a cartridge-like container on an ejection device 14 for ejecting a viscous compound such as a sealing compound, adhesive or hot-melt adhesive contained in the cartridge 12.

According to the invention the casing 10 comprises a telescopic jacket part 16, 18 which comprises a first tubular part 16 on which a second tubular part 18 is arranged in such a manner that it can coaxially shift in an axial direction in order to be able to carry out an adaptation without problems to cartridges with different lengths.

In the exemplary embodiment shown, the casing 10 comprises a third, non-telescopic jacket part 20 via which the casing 10 can be adapted to the ejection device. Of course, the first tubular part can also be directly connected such as screwed to the ejection device.

For the adaptation to the ejection device 14, the non-telescopic jacket part 20 comprises on a first end a first connection element such as a thread 22 which can be connected such as screwed in to a second connection element such as a thread in a flange 24 of the ejection device 14. The cartridge 12 lies with a circumferential edge 26 on a front-side edge 28 of the jacket part 20 and is fixed during the screwing into the flange 24 between the front-side edge 28 and a stop of the flange 24. On a second end the non-telescopic jacket part 20 comprises laterally projecting projections 30 which form a bayonet closure with an L-shaped guide 33 formed in a front-side flange 32 of the first part 16.

The shiftable part 18 is cogged by catch elements 34 such as catch noses with corresponding catch elements 36 such as projections or recesses which extend radially from the fixed part 16 or are let into the latter and can be stopped at different positions.

In order to make possible a simple mounting of the shiftable part 18 on the fixed part 16, it is provided that a wall of the fixed part 16 comprises recesses 38 extending in a longitudinal direction from the flange 32 of the fixed part 16 so that individual webs 40 are formed. Corresponding to the recesses 38, recesses 42 in the shape of longitudinal slots are introduced in a wall of the shiftable part 18, which correspond to the recesses 38 in order to be able to observe the filling status of the cartridge 12.

The ejection device 14 is designed in the exemplary embodiment shown like a pistol handle 44 which can be coupled by connections 46, 48 to a compressed air line. The inflow of compressed air into the cartridge 12 can be controlled via an actuation valve by the actuating element 50. The valve is connected via a pressure line 51 to the flange 24.

The FIG. 2 to 4 show the casing 10 in different states, each with cartridges 12, 56, 60 with different lengths. FIG. 2 shows the casing 10 in its longest, drawn-out state, wherein the cartridge 12 is introduced into the casing. In this state the casing 10 also comprises the non-telescopic jacket part 20, the first part 16, which is connected by the bayonet closure 32 to the jacket part 20, and comprises the shiftable part 18 which is stopped in an end position.

In this state the catch nose 34 rests against a front-side catch nose 52 extending from the web 40 of the first part 18 and which rests, pretensioned by a spring, against an inner surface 54 of the shiftable part 18. A shifting back of the shiftable part 18 is prevented by the catch element 36 in the form of a projection 36 radially extending from the web 40.

In the state shown, the cartridge 12 with a length of, for example, ca. 300 mm is completely surrounded by the casing.

FIG. 3 shows the casing 10 in a pushed-in state for receiving a cartridge 56 with a length of e.g. ca. 180 mm to 220 mm. In the pushed-in state the catch nose 34 extends behind a projection 58 so that the shiftable part 18 is fixed in the pushed-in position.

In order to receive a cartridge 60 in a length of e.g. ca. 100 mm, the non-telescopic jacket part 20 is provided which is designed at the same time as an adapter between the ejection device 14 and the first part 16.

FIG. 5 shows the casing 10 for the coaxial receiving and adaption of the cartridge 12 by an adapter ring 62 on the ejection device 14 for ejecting a viscous compound such as sealing compound, adhesive or hot-melt adhesive contained in the cartridge 12.

The adapter ring 62 comprises a conical clamping surface 64 which tapers in the direction of the circumferential edge 26 of the cartridge. During the screwing in of the casing into the flange 24, the conical surface 64 engages into the circumferential edge 26 of the cartridge 12 so that the edge 26 is loaded with force during the tightened screwing in a radial direction against an inner surface 66 of the flange 24 and is fixed. The adapter ring 62 can be constructed as a loose structural component or as a fixed component of the ejector device 14. A central opening 68 is provided for conducting compressed air through.

An alternative embodiment of the L-shaped guide 33 comprises a first part 70 extending in the circumferential direction and a second part 72 extending in the axial direction. The part 70 extending in the circumferential direction is aligned in such a manner that the thread 22 is screwed into the flange 24 during the tightening of the bayonet closure.

The telescopic casing according to the invention makes possible a smooth adaptation to cartridges with different lengths. In order to process, e.g., four commercial cartridges with different lengths, according to the prior art four casings are obligatorily necessary whereas according to the invention only two elements are sufficient.

The invention claimed is:

1. A casing for coaxially receiving and adapting a cartridge, or a cartridge-like container, on an ejection device for ejecting a viscous compound contained in the cartridge, or in the cartridge-like container, the casing comprising:

a telescopic jacket part, wherein the telescopic jacket part comprises at least two tubular parts which are arranged coaxially in parts relative to each other and which can be shifted in the axial direction relative to each other, wherein the tubular parts are cogged to each other by catch elements and can be stopped in different positions relative to each other, that the first tubular part comprises, on a first end, a flange with coupling element and can be connected with the coupling element by an intermediate piece in a detachable manner to the ejection device, wherein the first tubular part comprises a sliding part on which the second tubular part in the form of a sliding jacket can be shifted between a first stoppable position into at least one second stoppable position, wherein the intermediate part is part of the casing and forms a third tubular jacket part for receiving the cartridges or cartridge-like containers, wherein the third jacket part is connected on a first end via a first connection to a flange of the ejection device, and wherein the third tubular jacket part is connected on a second end by a second connection to the first part of the telescopic jacket part.

2. The casing according to claim 1, wherein the second, shiftable part comprises catch elements on a front side facing the first fixed part, wherein the catch elements cooperate with corresponding catch elements starting from the sliding part.

3. The casing according to claim 1, wherein the first part comprises webs forming the sliding part and starting from the flange, and extending in the axial direction, wherein the webs comprise the catch elements on their ends and against which the catch elements of the second shiftable part rest in the end position.

4. The casing according to claim 3, wherein the second shiftable part comprises recesses in the form of longitudinal slots as viewing windows in a jacket surface which correspond to corresponding recesses between the webs of the first fixed part.

5. The casing according to claim 1, wherein the second connection is configured as a pin which cooperates in the shape of a bayonet closure with the coupling element in the form of an L-shaped receptacle, wherein a part of the receptacle, and running in a circumferential direction, is aligned in such a manner that the closing of the bayonet closure brings about a tightening of the intermediate part.

6. The casing according to claim 1, wherein the second shiftable part has a tapering on the front side.

7. The casing according to claim 1, wherein the third tubular jacket part has a length L0 in a range of 80 mm<L0<120 mm.

8. The casing according to claim 1, wherein, in a pushed-in state, the telescopic jacket part has a length L1 in a range of 120 mm<L1<180 mm.

9. The casing according to claim 1, wherein, in a drawn-out state, the telescopic jacket part has a length L2 in a range of 280 mm<L2<330 mm.

10. The casing according to claim 1, wherein the casing is produced from plastic or metal.

11. An ejection device comprising the casing according to claim 1.

12. The casing according to claim 7, wherein L0 is about 100 mm.

13. The casing according to claim 8, wherein L1 is about 150 mm.

14. The casing according to claim 9, wherein L2 is about 300 mm.

15. The casing according to claim 10, wherein the metal is aluminum.

* * * * *